US009597919B1

(12) United States Patent
Ruggles et al.

(10) Patent No.: US 9,597,919 B1
(45) Date of Patent: Mar. 21, 2017

(54) TRADING CARD AUTOGRAPH CLIPBOARD

(71) Applicants: Allen Lee Ruggles, Ramona, CA (US); Michael Kent Roberts, Poway, CA (US)

(72) Inventors: Allen Lee Ruggles, Ramona, CA (US); Michael Kent Roberts, Poway, CA (US)

( * ) Notice: Subject to any disclaimer, the term of this patent is extended or adjusted under 35 U.S.C. 154(b) by 0 days.

(21) Appl. No.: 15/265,635

(22) Filed: Sep. 14, 2016

(51) Int. Cl.
*A47B 97/04* (2006.01)
*B42F 9/00* (2006.01)
*B42F 17/18* (2006.01)

(52) U.S. Cl.
CPC ..... *B42F 9/001* (2013.01); *B42F 17/18* (2013.01)

(58) Field of Classification Search
CPC . B42F 9/001; B42F 17/18; B42F 9/00; A47G 2001/0667; A47G 1/12; G09F 1/10
USPC ..... 248/450; 40/124, 124.2, 124.4, 790–791, 40/124.01, 777, 453
See application file for complete search history.

(56) References Cited

U.S. PATENT DOCUMENTS 546,151 A * 9/1895 Herbert ..... A47G 1/06 40/784
868,458 A * 10/1907 Lentz ..... B42F 5/00 281/34
1,088,837 A * 3/1914 Passmore ..... B42F 9/001 24/67.5
1,340,369 A * 5/1920 Boughton ..... A47G 1/0633 40/777
2,056,565 A * 10/1936 Coray ..... G09F 15/0018 40/757
2,736,975 A * 3/1956 Grotthuss ..... G03B 21/64 359/477
3,670,370 A * 6/1972 Goodwin ..... B42F 9/001 24/334
3,848,547 A * 11/1974 Schaefer ..... F41H 5/08 109/49.5
4,146,985 A * 4/1979 Margulies ..... G03B 21/64 40/537
4,401,323 A * 8/1983 Rex ..... B42F 9/00 24/67.11
5,042,180 A * 8/1991 Horiuchi ..... A47G 1/0611 40/788
5,046,616 A * 9/1991 Makowski ..... B65D 73/0007 206/455
5,092,062 A * 3/1992 Palka ..... G09F 7/08 40/124.2

(Continued)

*Primary Examiner* — Christopher E Garft
(74) *Attorney, Agent, or Firm* — ARC IP Law, PC; Joseph J. Mayo

(57) ABSTRACT

A clipboard that holds trading cards in a protected, secure position and that allows them to be signed while in the clipboard. The clipboard has recessed regions into which trading cards may be placed. Cards are held in place by retaining tabs along the bottom edge, and by a clip that contacts the top edge of the cards; thus the majority of the cards' areas are exposed for autographs. The edges of the recessed regions are offset from the corners with corner relief regions to prevent damage to the corners of the cards. Finger holes through the back of the recessed regions allow a user to push the cards gently out of the recessed area for removal. The clipboard may have a top hole for attachment of a lanyard that may be used to carry the clipboard or to lower it to a person for an autograph or signature.

15 Claims, 3 Drawing Sheets

(56) References Cited

U.S. PATENT DOCUMENTS 5,096,752 A * 3/1992 Wagner ..... A47G 23/0303 40/654.01
5,097,953 A * 3/1992 Gingras ..... G09F 1/10 206/39
5,119,574 A * 6/1992 King ..... G09F 5/04 206/39
D340,880 S * 11/1993 Walton ..... D11/132
5,259,517 A * 11/1993 Pancoe ..... A47F 5/0846 211/163
5,419,062 A * 5/1995 Polinski ..... G09F 7/10 40/124.4
5,566,609 A * 10/1996 Kirschner ..... B62B 3/1428 108/42
5,577,609 A * 11/1996 Hexter, Jr. ..... A47G 1/143 206/449
5,669,167 A * 9/1997 Kemp ..... G09F 1/10 40/642.02
5,988,405 A * 11/1999 Weisenburger ..... A47F 7/146 211/40
6,308,831 B1 * 10/2001 Saxe ..... B42F 7/14 206/38
6,666,341 B2 * 12/2003 Boron ..... G11B 33/0461 211/40
6,854,915 B1 * 2/2005 Ong ..... B42F 13/0013 206/472
7,814,693 B2 * 10/2010 Simba ..... G11B 33/0411 206/308.1
8,011,510 B1 * 9/2011 Smith, II ..... B65D 43/162 206/449
8,517,330 B1 * 8/2013 Joyce ..... B42F 9/001 24/67.3
8,656,618 B2 * 2/2014 Dai ..... H05K 5/0017 206/39
2002/0027358 A1 * 3/2002 Peppers ..... B42F 9/001 281/45
2002/0108286 A1 * 8/2002 Brockley ..... A47G 1/0616 40/800
2002/0162935 A1 * 11/2002 Hardy ..... A47B 23/044 248/460
2005/0050787 A1 * 3/2005 Chang ..... A47G 1/06 40/658
2007/0126224 A1 * 6/2007 Isaacs ..... B42F 9/001 281/45
2008/0120874 A1 * 5/2008 Schroeder ..... G09F 1/10 40/124.4
2008/0149505 A1 * 6/2008 Cunningham ..... A63B 45/02 206/232
2008/0164688 A1 * 7/2008 Huff ..... B42F 9/002 281/45
2008/0196211 A1 * 8/2008 Cheng ..... B42F 9/001 24/67.7
2008/0220405 A1 * 9/2008 Lynch ..... A63B 69/00 434/409
2009/0019738 A1 * 1/2009 Cunningham ..... B43K 23/001 40/1
2011/0317448 A1 * 12/2011 Podd ..... B60Q 1/2673 362/628
2012/0091308 A1 * 4/2012 Small ..... B42F 9/001 248/452
2013/0246692 A1 * 9/2013 Macor ..... G07D 9/002 711/103
2013/0256494 A1 * 10/2013 Ou-Yang ..... F16M 13/00 248/450
2015/0034799 A1 * 2/2015 Krapf ..... B43L 1/00 248/683

* cited by examiner

TRADING CARD AUTOGRAPH CLIPBOARD

BACKGROUND OF THE INVENTION

Field of the Invention

One or more embodiments of the invention are related to the field of holders for memorabilia. More particularly, but not by way of limitation, one or more embodiments of the invention enable a trading card autograph clipboard that holds trading cards securely in position and that allows people to easily sign the cards.

Description of the Related Art

In the prior art various types of holders and display cases exist for sports memorabilia such as baseball trading cards. For example, U.S. Utility Pat. No. 5,669,167, "Suspended Trading Card Holder," discloses a holder that sandwiches a trading card between two transparent plates. This holder, like others known in the art, is intended to preserve trading cards and present them for display. In particular, since it covers a card with a top plate, the cards cannot be signed while in the holder. Collectors and traders of cards often wish to have cards signed by the athlete on the card. There are no known solutions that hold a trading card in a secure location while also presenting it in a way that facilitates signing the card.

For at least the limitations described above there is a need for a trading card autograph clipboard.

BRIEF SUMMARY OF THE INVENTION

One or more embodiments described in the specification are related to a trading card autograph clipboard. Embodiments of the invention enable trading cards to be held securely without damage and to be presented to a person for an autograph or signature. Trading cards may include for example, without limitation, sports trading cards such as baseball cards; cards with comic characters; cards for trading card games such as Magic™; cards with television or movie characters or actors; and more generally any type of card with any image or information that may be collected, displayed, exhibited, or traded.

One or more embodiments of the invention may have a flat base plate with two card holders integrated into the plate. Each card holder may have a recessed rectangular region to hold a card. A recessed corner relief region may be located around each corner of each rectangular region, to prevent damage to the corners of the cards. Inside each rectangular region there may be a finger hole that a user may use to push a card out of the recessed region from behind the clipboard. Cards may be held in place by retaining tabs at the lower left and lower right corners, and by a clip that contacts the cards at the top edge of the cards. The clip may have a pivoting retaining arm with a closed position and an open position. When the retaining arm is in the closed position, it may contact the cards near their top edges.

In one or more embodiments the clip may include a spring that biases the retaining arm towards the closed position, pushing it against trading cards installed into the card holding regions. In one or more embodiments the areas of the retaining arm that contact the cards may be covered with a compliant sleeve or with a material that prevents damage to the cards.

In one or more embodiments the finger holes may be circular. In one or more embodiments the finger holes may have diameters between ½ inches and 1½ inches. In one or more embodiments the corner relief regions at the corners of the card holding regions may be circular. In one or more embodiments the corner relief regions may have diameters between 1/16 inches and 3/16 inches. In one or more embodiments the corner relief regions may include indentations in the base plate with a bottom surface that is flush with the bottom surface of the corresponding recessed rectangular region. In one or more embodiments the corner relief regions may include a hole through the base plate.

In one or more embodiments the base plate may be approximately rectangular, and the card holding regions may be oriented with their top edges parallel to the top edge of the base plate. One or more embodiments may have a hole near the midpoint of the base plate top edge, which may be used for attachment of a lanyard for example.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A trading card autograph clipboard will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
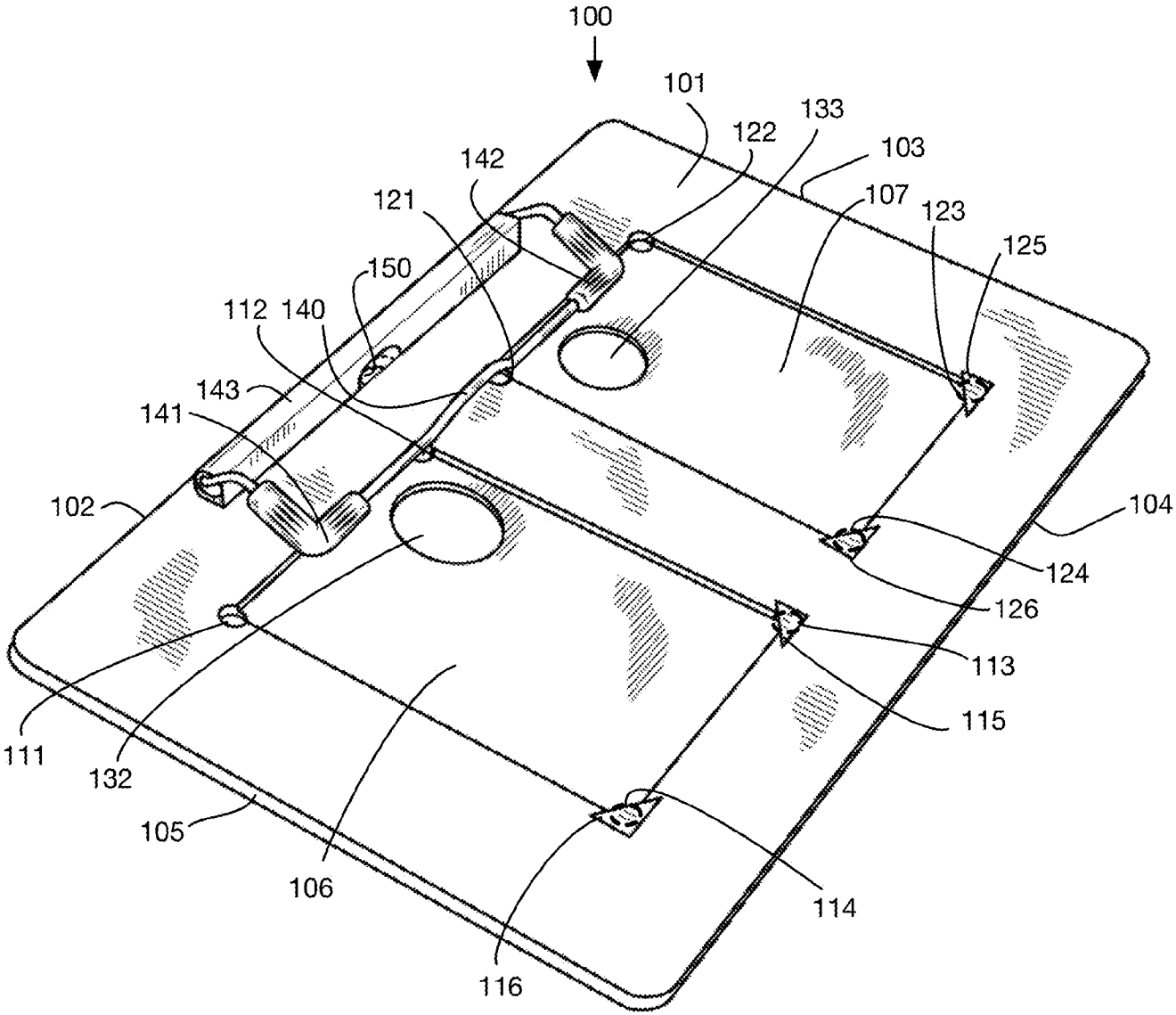
FIG. 1 shows a perspective view of an embodiment of the invention, illustrating two card holders with recessed regions for holding the cards, and a clip that holds the cards in place.

FIG. 1 shows a perspective view of an embodiment of the invention. Trading card autograph clipboard 100 has a base plate 101. This plate may be generally flat, with recesses and holes manufactured into the plate as described below. It may be constructed for example, without limitation, of acrylic or of injection molded plastic. The rectangular shape of base plate 101 is illustrative; in one or more embodiments the base plate may be of any desired size and shape. Base plate 101 has a front side as shown, a back side which is not shown in FIG. 1, a top edge 102, a right edge 103, a bottom edge 104, and a left edge 105.

Base plate 101 has two recessed, rectangular regions for holding trading cards. Region 106 is on the left side of the plate and region 107 is on the right side of the plate. In this illustrative embodiment, the rectangular recessed regions 106 and 107 have top edges that are parallel to the top edge 102 of the base plate; however, one or more embodiments may orient and arrange card holding regions in any desired manner. The recessed regions 106 and 107 may be sized to accommodate a trading card or any similar item. A trading card or other item that may be placed into the recessed regions may include for example, without limitation, a sports trading card, a card depicting a comic character, a card depicting a television or movie character, a card for a trading card game or other game, a card for a celebrity, a card for an actor, or more generally any type of card showing any image or information that may be displayed, exhibited, collected, or traded. One or more embodiments may have only one recessed region in the base plate for a trading card. One or more embodiments may have three or more recessed regions in the base plate for trading cards. One or more embodiments may have multiple recessed regions of different shapes or different sizes.

At the corners of the recessed regions 106 and 107, corner relief regions may be placed around the corners. These corner relief regions may for example include recessed regions that have bottom surfaces that are flush with the bottom surfaces of the recessed rectangular regions 106 and 107. They may for example include holes through the base plate. These corner relief regions ensure that the corners of the cards placed into the recessed regions do not contact material at the corner, thereby preventing damage to the corners. For example, recessed region 106 has corner relief regions at the four corners 111, 112, 113, and 114, and recessed region 107 has corner relief regions at the four corners 121, 122, 123, and 124. Corner relief regions 113, 114, 123 and 124 at the bottom edges of the recessed regions are not visible because they are covered by retaining tabs; thus these corner relief regions are shown with dashed lines. Corner relief regions may be of any size and shape. In one or more embodiments corner relief regions may be approximately circular, with diameters for example between 1/16 and 3/16 inches. In one or more embodiments the corner relief regions may be implemented as indentations that do not extend all the way through the base plate, wherein the indentations extend at least to the recessed region depth.

In the interior of each recessed region there is a finger hole that a user may use to push a card out of the region, pushing from behind the clipboard. This feature ensures that the user does not need to try to grab the card by the edges, which could potentially damage the card. Thus recessed region 106 has a finger hole 132 near its upper right corner, and recessed region 107 has a finger hole 133 near its upper left corner. One or more embodiments may have multiple finger holes for a recessed region. In one or more embodiments the finger holes may be approximately circular, with a diameter for example between ½ inches and 1½ inches. This size and shape is illustrative; one or more embodiments may have finger holes of any desired size and shape.

When trading cards are inserted into the recessed regions 106 and 107, they are held in place along the bottom edges by retaining tabs 115, 116, 125, and 126. These tabs may be attached to the front face of plate 101. In one or more embodiments the tabs may be integral to the base plate 101. The tabs may cover a portion of the lower left and lower right corners of the cards installed into the recessed regions. Tabs may be of any size and shape.

Trading cards may be held in place along the top edges by a clip. The clip in FIG. 1 has a retaining arm 140 that pivots to open or close. When closed, the retaining arm 140 contacts the cards at areas that may be near the top edges of the recessed regions 106 and 107. By holding the cards at the top with the retaining arm 140, and at the bottom with tabs 115, 116, 125, and 126, the clipboard 100 exposes most of the trading cards' areas to allow autographs or signatures to be placed anywhere on the cards. In one or more embodiments the areas where the retaining arm 140 contacts the cards may be covered with a sleeve of compliant material, such as a soft rubber, to further prevent damage to the cards. In the embodiment shown in FIG. 1, compliant sleeves 141 and 142 cover the parts of retaining arm 140 that contact the trading cards. In one or more embodiments the entire retaining arm 140 may be constructed of a material that does not damage the cards. In one or more embodiments there may be separate clips for each recessed region.

In one or more embodiments the clip may include a spring or similar mechanism to push the retaining arm against the trading cards. For example, the embodiment shown in FIG. 1 has a spring inside clip housing 143 that holds retaining arm 140 against the trading cards. One or more embodiments may use a latch or similar locking mechanism instead of or in addition to a spring.

Base plate 101 may have a top center hole 150 that may be used for example for attachment of a lanyard or a cord for holding the clipboard. For example, by attaching a lanyard to the clipboard a user may be able pass the clipboard to someone in a venue to obtain an autograph or signature, and retrieve the clipboard using the lanyard. For example, for a baseball trading card a user may lower the clipboard from the stands into a dugout, over a fence, or onto a field to obtain an autograph on a trading card.

Figure 2:
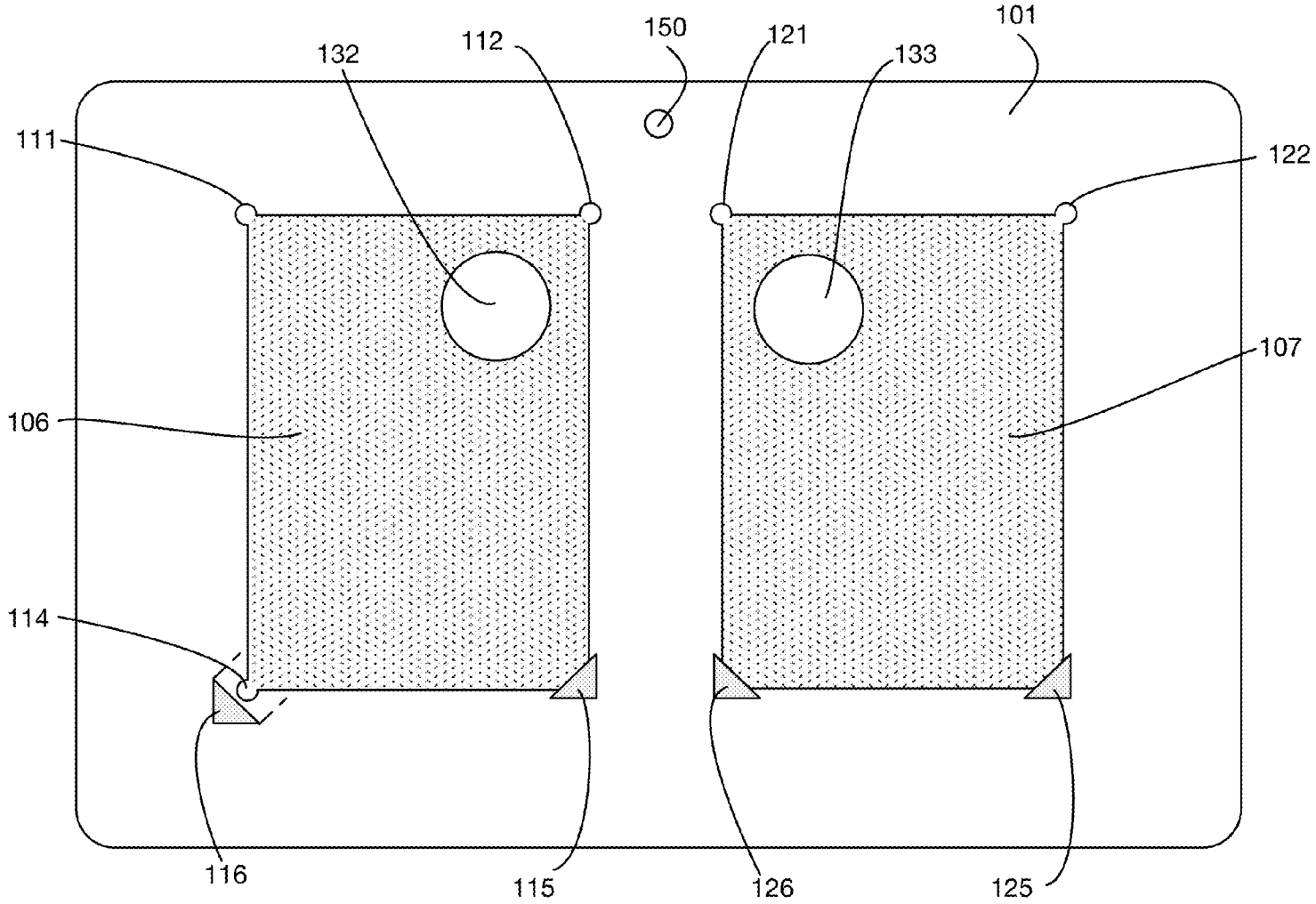
FIG. 2 shows a simplified top view of the embodiment of FIG. 1, with the clip removed.

FIG. 2 shows a simplified top view of the embodiment of FIG. 1, with the clip and retaining arm not shown for ease of illustration. Lower left retaining tab 116 of recessed region 106 is shown offset from corner relief region 114 so that the corner relief region is visible.

Figure 3:
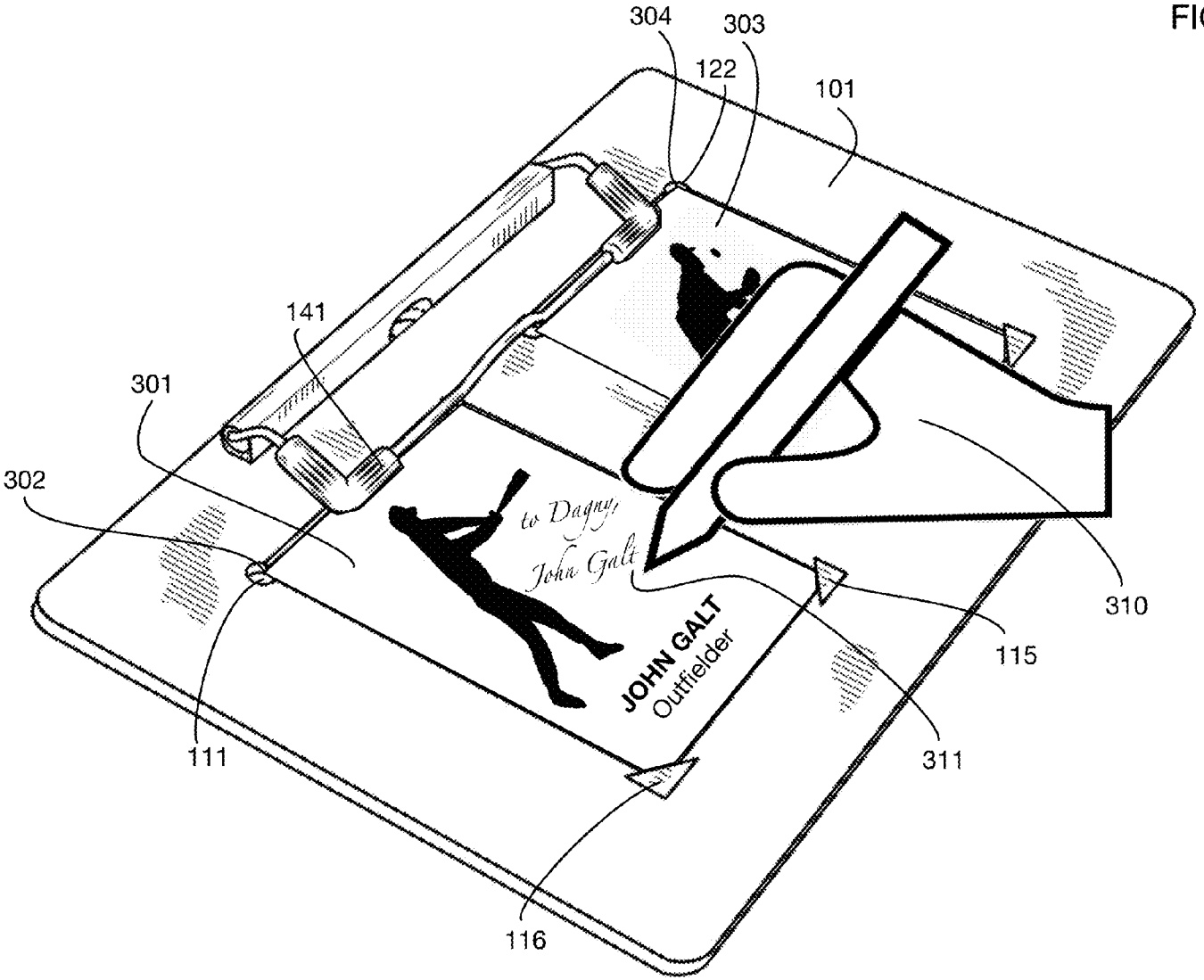
FIG. 3 shows the embodiment of FIG. 1 with trading cards placed in the card holder regions.

FIG. 3 shows the embodiment of FIG. 1 with trading cards 301 and 303 installed in the left recessed region and right recessed region, respectively. Corner 302 of card 301 lies within corner relief region 111, so that there is no force on the corner that might damage the card. Similarly corner 304 of card 303 is within the upper right corner relief region 122 of the right recessed region. Player 310 adds autograph 311 to card 301 in the exposed area left free between the retaining tabs 115, 116 and the sleeve 141 of the retaining arm.

While the invention herein disclosed has been described by means of specific embodiments and applications thereof, numerous modifications and variations could be made thereto by those skilled in the art without departing from the scope of the invention set forth in the claims.

What is claimed is:

1. A trading card autograph clipboard comprising:

a base plate that is substantially planar, having a front side and a back side;

two card holders integrated into said base plate, each card holder of said two card holders comprising a recessed rectangular region within said base plate, having a top edge, a bottom edge, a left edge, and a right edge, wherein said base plate has a finger hole through said base plate located within an interior of said recessed rectangular region;

a corner relief region within said base plate located at each corner of said recessed rectangular region, wherein each corner of said recessed rectangular region lies within an interior of its corresponding corner relief region;

a bottom left retaining tab coupled to said front side of said base plate that covers the corner relief region located at a bottom left corner of said recessed rectangular region, said bottom left corner located at an intersection of said bottom edge and said left edge;

a bottom right retaining tab coupled to said front side of said base plate that covers the corner relief region located at a bottom right corner of said recessed rectangular region, said bottom right corner located at an intersection of said bottom edge and said right edge;

a clip coupled to said front side of said base plate, comprising a pivoting retaining arm having an open position and a closed position, wherein when in said closed position said pivoting retaining arm contacts a card inserted into either card holder of said two card holders at a contact area that is proximal to said top edge of said recessed rectangular region associated with said card holder.

2. The trading card autograph clipboard of claim 1, wherein said clip further comprises a spring that biases said pivoting retaining arm towards said closed position.

3. The trading card autograph clipboard of claim 1, wherein said pivoting retaining arm comprises a compliant sleeve that covers said pivoting retaining arm at one or more locations where said pivoting retaining arm contacts said card inserted into either card holder of said two card holders.

4. The trading card autograph clipboard of claim 1, wherein said finger hole associated with each said recessed rectangular region is substantially circular.

5. The trading card autograph clipboard of claim 1, wherein said finger hole associated with each said recessed rectangular region has a diameter greater than or equal to 0.5 inches.

6. The trading card autograph clipboard of claim 1, wherein said finger hole associated with each said recessed rectangular region has a diameter less than or equal to 1.5 inches.

7. The trading card autograph clipboard of claim 1, wherein each corner relief region located at each corner of each said recessed rectangular region comprises a recessed area having a bottom surface that is flush with a corresponding bottom surface of said recessed rectangular region.

8. The trading card autograph clipboard of claim 1, wherein said base plate has a hole through said base plate located within each corner relief region.

9. The trading card autograph clipboard of claim 1, wherein each corner relief region located at each corner of each said recessed rectangular region is substantially circular.

10. The trading card autograph clipboard of claim 1, wherein each corner relief region located at each corner of each said recessed rectangular region has a diameter greater than or equal to 1/16 inches.

11. The trading card autograph clipboard of claim 1, wherein each corner relief region located at each corner of each said recessed rectangular region has a diameter less than or equal to 3/16 inches.

12. The trading card autograph clipboard of claim 1, wherein said base plate is substantially rectangular, having a base plate top edge that is substantially parallel to said top edge of said recessed rectangular region associated with each card holder of said two card holders.

13. The trading card autograph clipboard of claim 4, wherein said base plate has a top hole located proximal to a midpoint of a top edge of said base plate.

14. The trading card autograph clipboard of claim 13, wherein said pivoting retaining arm comprises a compliant sleeve that covers said pivoting retaining arm at one or more locations where said pivoting retaining arm contacts said card inserted into either card holder of said two card holders.

15. A trading card autograph clipboard comprising:

a base plate that is substantially planar and substantially rectangular, having a front side;

a back side;

a base plate top edge;

a top hole located proximal to a midpoint of said base plate top edge;

two card holders integrated into said base plate, each card holder of said two card holders comprising a recessed rectangular region within said base plate, having a top edge that is substantially parallel to said base plate top edge, a bottom edge, a left edge, and a right edge, wherein said base plate has a finger hole through said base plate located within an interior of said recessed rectangular region, wherein said finger hole is substantially circular and has a diameter between 0.5 inches and 1.5 inches;

a corner relief region within said base plate located at each corner of said recessed rectangular region, wherein each corner of said recessed rectangular region lies within an interior of its corresponding corner relief region;

said corner relief region is substantially circular, having a center at the corresponding corner of said recessed rectangular region and having a diameter between 1/16 inches and 3/16 inches;

said corner relief region comprises a recessed area having a bottom surface that is flush with a corresponding bottom surface of said recessed rectangular region;

a bottom left retaining tab coupled to said front side of said base plate that covers the corner relief region located at a bottom left corner of said recessed rectangular region, said bottom left corner located at an intersection of said bottom edge and said left edge;

a bottom right retaining tab coupled to said front side of said base plate that covers the corner relief region located at a bottom right corner of said recessed rectangular region, said bottom right corner located at an intersection of said bottom edge and said right edge;

a clip coupled to said front side of said base plate, comprising a pivoting retaining arm having an open position and a closed position, wherein when in said closed position said pivoting retaining arm contacts a card inserted into either card holder of said two card holders at a contact area that is proximal to said top edge of said recessed rectangular region associated with said card holder;

a compliant sleeve that covers said pivoting retaining arm at one or more locations where said pivoting retaining arm contacts said card inserted into either card holder of said two card holders;

a spring that biases said pivoting retaining arm towards said closed position.

* * * * *